US005912190A

United States Patent [19]

Barr et al.

[11] Patent Number: 5,912,190

[45] Date of Patent: Jun. 15, 1999

[54] SYNERGISTIC PROCESS FOR IMPROVING COMBUSTION

[75] Inventors: Donald Barr, South Wirral; Stephen L. Cook, Chester; Paul J. Richards; Maurice W. Rush, both of Buckinghamshire, all of United Kingdom

[73] Assignee: The Associated Octel Company Limited, London, United Kingdom

[21] Appl. No.: 08/945,351

[22] PCT Filed: Apr. 24, 1996

[86] PCT No.: PCT/GB96/00991

§ 371 Date: Feb. 2, 1998

§ 102(e) Date: Feb. 2, 1998

[87] PCT Pub. No.: WO96/34075

PCT Pub. Date: Oct. 31, 1996

[30] Foreign Application Priority Data

Apr. 24, 1995 [GB] United Kingdom ..... 9508248

[51] Int. Cl.[6] ..... C10L 1/30; C10L 1/18

[52] U.S. Cl. ..... 44/330; 44/331; 44/385; 44/386

[58] Field of Search ..... 414/330, 331, 414/385, 386

[56] References Cited

U.S. PATENT DOCUMENTS

| | | | |
|---|---|---|---|
| 4,685,291 | 8/1987 | Ha . | |
| 5,304,783 | 4/1994 | Clough et al. . | |
| 5,344,467 | 9/1994 | Huang et al. | 44/358 |
| 5,534,039 | 7/1996 | Huang et al. | 44/367 |
| 5,535,708 | 7/1996 | Valentine | 44/301 |
| 5,584,265 | 12/1996 | Rao et al. | 44/335 |
| 5,584,894 | 12/1996 | Peter-Hoblyn | 44/301 |
| 5,593,464 | 1/1997 | Cook et al. | 44/358 |

FOREIGN PATENT DOCUMENTS

| | | |
|---|---|---|
| 0 141 998 | 5/1985 | European Pat. Off. . |
| 0 190 492 | 8/1986 | European Pat. Off. . |
| 2 248 068 | 9/1990 | United Kingdom . |
| WO 92/20762 | 11/1992 | WIPO . |
| WO 95/02655 | 1/1995 | WIPO . |
| WO 95/04119 | 2/1995 | WIPO . |

*Primary Examiner*—Jacqueline V. Howard
*Attorney, Agent, or Firm*—Nixon & Vanderhye P.C.

[57] ABSTRACT

A process of improving the combustion of fuel and/or improving the oxidation of carbonaceous products derived from the combustion or pyrolysis of fuel is described. The process comprises adding to the fuel before the combustion thereof a composition comprising a mixture of organo-metallic complexes, characterised in that the organo-metallic complexes only consist of Group I and Group II organo-metallic complexes and wherein the composition comprises at least one Group I organo-metallic complex and at least one Group II organo-metallic complex.

30 Claims, 3 Drawing Sheets

TYPICAL 3M DIESEL FILTER CARTRIDGE

SYNERGISTIC PROCESS FOR IMPROVING COMBUSTION

Figure 1:
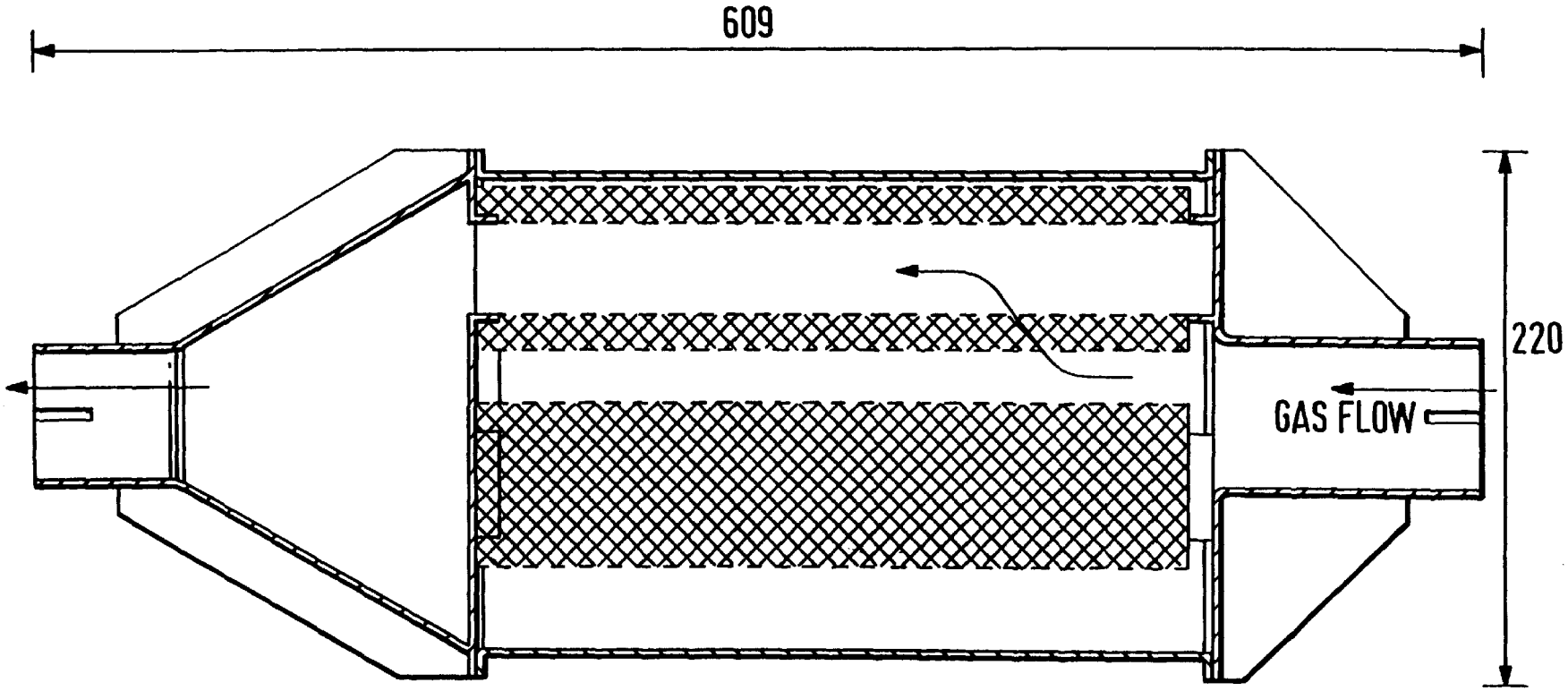

This application is a 371 of PCT/GB96/00991 Apr. 24, 1996.

The present invention relates to a process for improving the combustion of fuel and/or improving the oxidation of carbonaceous products derived from the combustion or pyrolysis of fuel.

In particular, the present invention relates to as process for improving the combustion of fuel and/or improving the oxidation of carbonaceous products derived from the combustion or pyrolysis of fuel by use of the combination of at least one alkaline metal complex and at least one alkaline earth metal complex.

Products from the combustion or pyrolysis of hydrocarbon fuels include carbon monoxide, nitrous oxides ($NO_x$) unburnt hydrocarbons and particulates. These particulates include not only those particulates which are visible as smoke emission, but also unburned and partially oxidised hydrocarbons from fuel and the lubricants used in engines. The particulate and soot emission are known to be harmful and themselves contain harmful pollutants. In this regard, there is a growing recognition of the health risks associated with particulates emissions. In particular, unburned or partially oxidised hydrocarbons emitted to the atmosphere are irritant astringent materials. Further, in a problem recently highlighted for diesel fuel, emissions of particulate matter of less than 10 micrometers of principle dimension ("PM10 matter") is claimed to cause 10,000 deaths in England and Wales and 60,000 deaths in the USA annually, as published in the New Scientist, March 1994, p12. It is suspected that these smaller particles penetrate deeper into the lung and adhere.

Diesel fuels and diesel engines, and fuel combustors for heating units, are particularly prone to the emission of small size soot particulate material in the exhaust gas. Diesel engines especially are prone to emission of high levels of particulate matter when the engine is overloaded, worn or badly maintained. Particulate matter is also emitted from diesel engines exhausts when engines are operated at partial load and these emissions are normally invisible to the naked eye.

Combustors fuelled by liquid hydrocarbon fuels are also prone to emission of unburned and partially burned substances especially when operated on a frequent start-stop programme or when the burner parts are inadequately maintained. As energy regulations become more stringent the control and stop start operation of combustors must be improved.

Legislation now exists in many countries of the world that is designed to control pollution from diesel engines. More demanding legislation is planned. A number of ways are being examined to enable diesel engines to run and comply with the developing legislation. Engine designs to give effective combustion within the cylinder are being developed. The engine designs developed to achieve low levels of emission are well known to those familiar with the art and examples of such designs are given in S.A.E. International Congress (February 1995) S.A.E. Special Publication SP-1092. The drawbacks to the various engine management solutions include cost, complexity and the poor capability for retrofitting.

Many modern engine designs use a technology known as Exhaust Gas Recirculation (E.G.R.). In this regard, exhaust gas recycled in a controlled way to the intake of a diesel exhaust can contribute to the reduction of certain emissions species, mainly oxides of nitrogen. However, there is a drawback in using E.G.R. in that soot particles in the exhaust gas also become recirculated within the engine. Thus, engines running with E.G.R. for prolonged periods of time can become choked with carbon particulate in areas such as the exhaust gas recycle lines and control valves, inlet ports and valves, and the piston top ring glands. Even the piston rings themselves can become choked in the ring grooves. Also, the carbon and other particles become deposited in the engine lubricant so causing premature deterioration of the lubricant.

Particulate traps having the capability to oxidise collected material are also proposed in the light of forthcoming legislation. Such devices are well known to those familiar with the art and some examples are discussed in "Advanced techniques for thermal and catalytic diesel particulate trap regeneration", SAE International Congress (February 1985) SAE Special Publication-42 343–59 (1992) and S.A.E. International Congress (February 1995) S.A.E. Special Publication SP-1073 (1995). However, the trap oxidation solutions also suffer from the problems of expense, complexity and poor capability for retrofit. An additional problem is that of trap blockage which causes an increase in exhaust back pressure and a loss of engine efficiency and/or "chimney fires" resulting from sudden and intense burn off of soot from highly loaded traps.

Catalytic devices can assist the control of emissions from diesel engines. However, these devices require low sulphur fuel (<500 ppm) to enable benefits to exhaust emission to be achieved.

Also, low speed engine operation can cause carbonaceous deposits to form on the active parts of the diesel engine oxidation catalyst and so inhibit the effectiveness of the catalyst until a sufficiently high enough gas temperature is available to regenerate the catalyst active surface.

Exhaust catalyst devices fitted to diesel and gasoline fuelled engines become effective after engine start up when the exhaust gas passing the catalyst substrate exceeds about 250° C. Experimental work is proceeding to develop catalyst systems effective from temperatures below this level. Details are given in the proceedings of the S.A.E. International Congress February 1995; S.A.E. publications 950404 to 950412, inclusive. Cold engine operation such as stop start driving in gasoline vehicles, or prolonged engine idling for diesel engines, can cause a layer of soot and other carbonaceous material to form over the active catalyst surfaces. The emissions control of catalysts with active surfaces covered with soot and other carbonaceous material is poor, and additional vehicle driving distance or engine operation is necessary to heat the catalyst surfaces to regeneration conditions. Similarly, the performance of a lambda oxygen sensor in the exhaust gas of a gasoline fuelled engine can become degraded by cold engine stop-start driving and the formation of carbonaceous deposits on the exhaust gas sensing surface.

Carbonaceous deposits can even form on the combustion surfaces of engines. Particularly affected are gasoline engines where the deposits and residues from the combustion or pyrolysis of fuel and lubricant cause spark knock or can increase the emissions from the engine. Details on these aspects are given in the proceedings of the S.A.E. International congress February 1995; S.A.E. publication 950680.

Two stroke engines are also prone to the formation of deposits in the combustion chamber, such as on the piston crown and around the piston rings and ring grooves. Deposits also form in the exhaust ports of two stroke engines causing a loss of engine performance efficiency and emission control.

Additives have been used in an attempt to provide solutions to many of these problems.

WO-A-94/11467 to Platinum Plus discloses the use of platinum compounds in conjunction with a trap to lower the unburned hydrocarbon and carbon monoxide concentration of diesel exhaust gases. Lithium and sodium compounds are also claimed to be useful in lowering the regeneration temperature of the trap. No engine data is supplied in support of this claim. The teaching of this patent is that lithium and sodium organic salts are available and suitable for use to the extent that they are fuel soluble and are stable in solution. There is no suggestion that combinations of metals produce additional benefits.

DE-A-40 41 127 to Daimler-Benz describes the use of various fuel soluble, stable lithium and sodium salts in reducing the ignition temperature of the mateial retained within a diesel particulate filter. Frequent partial unblocking of the filter is observed at sodium levels of around 32 ppm m/m, 28 ppm m/m with lithium. There is no suggestion that any one fuel soluble, stable salt performs better than any other. There is also no teaching in this document that combinations of the additives might produce additional benefits.

EP-A-207 560 to Shell concerns the use of succinic acid derivatives and their alkali or alkaline earth metal (especially potassium) salts as additives for increasing the flame speed within spark ignition internal combustion engines. However, there is no teaching regarding the use of such additives in compression ignition engines. There is also no teaching in this document regarding the use of such additives in combination.

EP-A-555 006 to Slovnaft AS discloses the use of alkali or alkaline earth metal salts of derivatised alkenyl succinates as additives for reducing the extent of valve seat recession in gasoline engines designed for leaded fuel but used with non-leaded.

GB-A-2 248 068 to Exxon teaches the use of additives containing an alkali, an alkaline earth and a transition metal to reduce smoke and particulate emissions during the combustion of diesel fuel. According to the teachings of this document, the presence of a transition metal is essential.

EP-A-0 476 196 to Ethyl Petroleum Additives teaches the use of a three part composition including a soluble and stable manganese salt, a fuel soluble and stable alkali or alkaline earth metal and a neutral or basic detergent salt to reduce soot levels, particulates, and the acidity of carbonaceous combustion products.

EP-A-0 423 744 teaches the use of a hydrocarbon soluble alkali or alkaline earth metal containing composition in the prevention of valve seat recession in gasoline engines designed for leaded but run on unleaded fuel. There is no teaching in this document relevant to diesel combustion.

As there is still a need to control the formation of particulates and/or to prevent or to remove carbonaceous deposits, so there is still a need to prepare improved additives which will be of benefit in reducing the rate of deposition or in cleaning up existing deposits.

The present invention therefore seeks to provide a process for improving the combustion of fuel and/or improving the oxidation of carbonaceous products derived from the combustion or pyrolysis of fuel.

According to a first aspect of the present invention there is provided a process of improving the combustion of fuel and/or improving the oxidation of carbonaceous products derived from the combustion or pyrolysis of fuel (such as with the use of a particulate trap used with diesel engines), the process comprising adding to the fuel before the combustion thereof a composition comprising a mixture of organo-metallic complexes, characterised in that the organo-metallic complexes only consist of Group I and Group II organo-metallic complexes and wherein the composition comprises at least one Group I organo-metallic complex and at least one Group II organo-metallic complex.

According to a second aspect of the present invention there is provided a use of a combination of organo-metallic complexes as defined in the first aspect of the present invention for improving combustion of fuel and/or improving the oxidation of carbonaceous products derived from the combustion or pyrolysis of fuel (such as with the use of a particulate trap for use with diesel engines), wherein the complexes are added to the fuel before the combustion thereof, preferably wherein the total concentration of the metals of the Group I organo-metallic complex and the Group II organo-metallic complex in the fuel before combustion is 100 ppm or less, preferably 50 ppm or less. Many types of particulate traps are known to those skilled in the art including as non-limiting examples 'cracked wall' and 'deep bed' ceramic types and sintered metal types. The invention is suitable for use with all particulate traps; the optimum dose rate is a function of the trap type. For use with a particulate filter trap of the 'cracked wall' type, such as the Corning EX80™, a preferred total concentration of the metals of the Group I organometallic complex and the Group II organometallic complex in the fuel is 100 ppm or less. For use with a particulate filter trap of the 'deep bed' type, such as one constructed from 3M Nextel™ fibre, a preferred total concentration of the metals of the Group I organo-metallic complex and the Group II organometallic complex in the fuel is 50 ppm or less.

The key advantages of the present invention are that it provides additives for diesel and other hydrocarbon fuels that give an overall emissions benefit to the environment on combustion by any one or more of: improving the combustion process; controlling the formation of soot and carbonaceous deposits in engines and combustors; and improving the oxidation of particulates within trap systems, engines or exhaust systems.

The composition of the present invention promotes and sustains combustion in the trap. Another key advantage is that the composition of the present invention may be used in low dosage amounts.

Preferably, the total concentration of the metals of the Group I and the Group II organo-metallic complexes in the fuel before combustion is 30 ppm or less.

Preferably, for use with a particulate filter trap of the 'cracked wall' type, such as the Corning EX80™, the total concentration of the metals of the Group I and the Group II organo-metallic complexes in the fuel before combustion is 20 ppm or less.

Preferably, for use with a particulate filter trap of the 'deep bed' type, such as one constructed from 3M Nextel™ fibre, the total concentration of the metals of the Group I and the Group II organo-metallic complexes in the fuel before combustion is 20 ppm or less, preferably 5 ppm or less.

Preferably, the Group I organo-metallic complex is a complex of Na and/or K.

Preferably, the Group II organo-metallic complex is a complex of Sr and/or Ca, preferably Sr.

Preferably, each organo-metallic complexe is fuel soluble.

Preferably, each organometallic complex is soluble in a fuel-compatible solvent such that each organometallic complex is soluble to the extent of 10 wt %, preferably 25 wt % and most preferably 50 wt % or more in the solvent. Conveniently, the fuel-compatible solvent may comprise a poly(butene).

Preferably, the ratio of Group I organo-metallic complex to Group II organo-metallic complex is in the range of from 20:1 to 1:20, preferably from 10:1 to 1:10.

Preferably, the ratio of Group I organo-metallic complex to Group II organo-metallic complex is in the range of from 20:1 to 1:1, preferably from 10:1 to 1:1.

Preferably, in the composition there is more Group I organo-metallic complex than Group II organo-metallic complex.

Preferably, each of the organo-metallic complexes is of the formula $M(R)_m$. nL where M is the respective cation of an alkali metal or an alkaline earth metal, of valency m, not all metal cations (M) in the complex necessarily being the same; R is the residue of an organic compound RH, where R is an organic group containing an active hydrogen atom H replaceable by the metal M and attached to an O, S, P, N or C atom in the group R; n is a positive number indicating the number of donor ligand molecules forming a bond with the metal cation, but which can be zero; and L is a species or functional group capable of acting as a Lewis base.

Preferably, R and L for at least one of the complexes, preferably for each of the complexes, are in the same molecule.

Preferably, each organometallic complex is dosed to the fuel at any stage in the fuel supply chain.

Preferably each complex is added to the fuel close to the engine or combustion systems, within the fuel storage system for the engine or combustor, at the refinery, distribution terminal or at any other stage in the fuel supply chain.

The term "fuel" includes any hydrocarbon that can be used to generate power or heat. The term also covers fuel containing other additives such as dyes, cetane improvers, rust inhibitors, antistatic agents, gum inhibitors, metal deactivators, de-emulsifiers, upper cylinder lubricants, and anti-icing agents. Preferably, the term covers diesel fuel.

The term "diesel fuel" means a distillate hydrocarbon fuel or for compression ignition internal combustion engines meeting the standards set by BS 2869 Parts 1 and 2 as well as fuels in which hydrocarbons constitute a major component and alternative fuels such as rape seed oil and rape oil methyl ester.

The combustion of the fuel can occur in, for example, an engine such as a diesel engine, or any other suitable combustion system. Examples of other suitable combustion systems include recirculation engine systems, domestic burners and industrial burners.

The term "species capable of acting as a Lewis base" includes any atom or molecule that has one or more available electron pairs in accordance with the Lewis acid-base theory.

The term "regeneration" or "regenerating" means cleaning a particulate trap so that it contains minimal or no particulates. The usual regeneration process includes burning off the trapped particulates in and on the particulate trap. Regeneration of the trap is accompanied by a reduction in pressure drop across the trap.

The present invention therefore relates to additives for liquid hydrocarbon fuel, and fuel compositions containing them.

The composition of the present invention can have many uses, some of which are now described.

In engine management approaches, there is a well-known trade-off between $NO_x$ and particulates emissions. Diesel engines emissions tests now include specified levels for many pollutants. In some instances, the composition of the present invention achieves a useful level of particulates suppression and to such an extent that it decouples this trade off, thereby giving the engineer more freedom to achieve power output or fuel economy within a given emission standard.

In trap approaches, the composition of the present invention may be effective in reducing engine out emissions or as a combustion catalyst aiding the oxidation of trapped particles. Either way, the composition of the present invention provides for simpler, safer and less costly traps by enabling less frequent, less intense or less energetic regeneration, whether the heat required for the regeneration is provided by the exhaust gas or through some external mechanism.

In some instances, the combustion of fuel containing the composition of the present invention enables engines to be run at a full load and at a fractional load with a suitable trap arrangement and in doing so a self regenerating mechanism is initiated.

In some instances, when an engine and associated particulate trap are run burning a fuel containing the composition of the present invention there are provided two broad modes of trap function. First, a soot and particulate trapping stage associated with a minor clogging function can be observed. This is then followed by an automatic burn off or self-regeneration function. Trap conditions which favour self regeneration are influenced by particulate size and formation, the composition of unburned hydrocarbons, the back pressure and composition of the exhaust gas in the exhaust system. These discrete functions of trapping then burn off are particularly recordable at light to medium engine duty.

Up until now, many diesel trap devices have required complicated devices to initiate and control the exotherm of trap regeneration. In some instances, the composition of the present invention can significantly reduce or eliminate the need for regeneration initiation and control devices. The need for energy input to initiate the regeneration can also be substantially reduced or eliminated for many engine designs. At conditions of medium to full engine load the trapping and regeneration mechanisms operate simultaneously giving excellent control of the particulate emissions from diesel exhaust.

Preferably, the composition of the present invention is designed to remain compatible with hydrocarbon fuels and remain stable up to the point of entry to the combustion zone. The composition of the present invention when burned with the fuel can reduce the soot and carbonaceous material entrained in the exhaust gas recycle system of certain engines. Thus, the levels of soot and carbonaceous material that are subsequently trapped in the engine becomes reduced.

Burning of a fuel comprising the composition of the present invention gives particulate matter remaining in the exhaust gas which is in a form readily collectable on a trap. Further, when the fuel is burned with the additive of the present invention the trapped material exhibits a reduced ignition temperature and oxidation of the trapped material is enhanced, when compared to that of fuel burned without the composition of the present invention. The burning of soot and other hydrocarbons from the surfaces of a trap therefore provides a way to regenerate the filter and so prevent the unacceptable clogging of particulate traps.

Preferably, the composition of the present invention is designed so that very low levels of combustion or pyrolysis ash are formed. In this way clogging of the trap from additive residue is kept to a minimum.

When a fuel comprising the composition of the present invention is burned the fuel causes the carbonaceous deposits that form during stop start driving on the active surfaces of catalytic converters can be cleared away even from low driving duty thereby enabling a fast light off or early regeneration to full conversion efficiency.

When a fuel comprising the composition of the present invention is burned the fuel provides a significant reduction in levels of soot and carbonaceous deposits that form on the combustion surfaces of engines in the piston rings and piston ring bands, and also in the exhaust ports, thereby contributing to a maintenance of engine performance emissions and longevity.

Preferably, the composition of the present invention is designed such that the soot and hydrocarbons burned become emitted as water vapour, carbon monoxide and carbon dioxide.

A highly preferred aspect of the present invention is the use of metals of known low toxicity to prepare the composition of the present invention. Preferably the metals are those that are essential to life and are widely prevalent in the environment.

In a preferred embodiment, the composition of the present invention provides ultimate products that are readily water soluble, or soluble in solvents non-corrosive towards exhaust system components thereby simplifying any recycle of the system.

Preferably the composition of the present invention is fuel-soluble or fuel miscible. This serves to reduce the complexity and cost of any on-board dosing device.

A further advantage of a highly preferred composition of the invention is that it can be supplied in concentrated form in a suitable solvent that is fully compatible with diesel and other hydrocarbon fuels, such that blending of fuel and additive may be more easily and readily carried out.

A further advantage of a highly preferred composition of the present invention is that it is at least resistant and preferably totally inert towards water leaching, thus providing a fuel additive that is compatible with the fuel handling, storage and delivery systems in common use. In particular, diesel fuel often encounters water, especially during delivery to the point of sale and so the composition of the present invention is not affected by the presence of that water.

In one aspect of the present invention, the alkali metal and alkaline earth metal complexes of the present invention have the general formula $$M(R)_m.nL$$

where M is the cation of an alkali metal or an alkaline earth metal of valence m, R is the residue of an organic compound of formula RH where H represents an active hydrogen atom reactive with the metal M and attached either to a hetero atom selected from O, S and N in the organic group R, or to a carbon atom, that hetero or carbon being situated in the organic group R close to an electron withdrawing group, e.g. a hetero atom or group consisting of or containing O, S or N, or aromatic ring, e.g. phenyl, n is a number indicating the number of organic electron donor molecules (Lewis bases) forming dative bonds with the metal cation in the complex, usually up to five in number, more usually an integer from 1 to 4, and L is one or more organic electron donor ligand (Lewis base). R and L may be combined in the one molecule, in which case n can be and often is zero and L is a functional group capable of acting as a Lewis base.

In a more detailed aspect, the Lewis base metallo-organic co-ordination complexes used in accordance with the present invention contain the residue of an organic molecule RH which contains an active hydrogen atom H which is replaceable with a metal cation. In the organic compound RH the active hydrogen atom will be attached to a hetero atom (O, S, or N) or to a carbon atom close to an electron withdrawing group. The electron withdrawing group may be a hetero atom or group consisting of or containing O, S, or N, e.g. a carbonyl (>C=O), thione (>C=S) or imide (>C=NH) group, or an aromatic group, e.g. phenyl. When the electron withdrawing group is a hetero atom or group, the hetero atom or group may be situated in either an aliphatic or alicyclic group, which, when the active hydrogen group is an NH group, may or may not, but usually will contain that group as part of a heterocyclic ring.

Suitable complexes are derived from a β-diketone of the formula $$R^1C(O)CH_2C(O)\ R^2$$

where $R^1$ or $R^2$ is $C_1$–$C_5$, alkyl or substituted alkyl, e.g. halo-, amino-, alkoxy- or hydroxyalkyl-, $C_3$–$C_6$ cycloalkyl, benzyl, phenyl or $C_1$–$C_5$ alkylphenyl, e.g. tolyl, xylyl, etc., and where $R^1$ may be the same as or may be different to $R^2$.

Suitable β-diketones include:

hexafluoroacetylacetone: $CF_3C(O)CH_2C(O)\ CF_3$ (HFA);

2,2,6,6-tetramethylheptane-3,5-dione:

$(CH_3)_3CC(O)\ CH_2C(O)\ C(CH_3)_3$

If the active hydrogen atom is attached to oxygen in the organic compound RH, then suitable compounds include phenolic compounds containing from 6–30 carbon atoms, preferably substituted phenols containing from 1–3 substituents selected from alkyl, alkylaminoalkyl, and alkoxy groups of 1–8 carbon atoms, e.g. cresols, guiacols, di-t-butylcresols, dimethylaminomethylene-cresol. The substituted phenols are particularly preferred.

Especially preferred compounds wherein the hydrogen atom is attached to oxygen in the organic compound RH are those derived from reaction of a metal hydroxide or other alkali or alkaline earth metal source with an alkyl or alkenyl substituted succinic anhydride or the hydrolysis product. Typically such anhydrides are those prepared by reaction of oligomerised isobutenes or other simple olefins with maleic anhydride. A wide variety of such alkyl or alkenyl substituted succinic anhydrides and a range of techniques for their preparation are known to those skilled in the art. In general, a high molecular weight poly(isobutene) substituent provides the resulting complex with good hydrocarbon solubility at the cost of lower metal content. We have found the alkenyl substituted succinic anhydride derived from the thermal reaction of BP Napvis X-10™ with maleic anhydride to give a good compromise between hydrocarbon solubility and metal content. Whilst not wishing to be bound by theoretical considerations, it is believed that in such compounds one carboxylic acid group is deprotonated and bound in salt-like fashion to metal ion and the second carboxylic acid group to be protonated and to bind as a Lewis base.

If the active hydrogen is attached to a nitrogen atom in the organic compound RH, then suitable compounds are heterocyclic compounds of up to 20 carbon atoms containing a —C(Y)—NH— group as part of the heterocycle, Y being either O, S or =NH. Suitable compounds are succinimide, 2-mercaptobenzoxazole, 2-mercaptopyrimidine, 2-mercaptothiazoline, 2-mercaptobenzimidazole, 2-oxobenzoxazole.

In more detail, L can be any suitable organic electron donor molecule (Lewis base), the preferred ones being hexamethylphosphoramide (HMPA), tetramethylethylenediamine (TMEDA), pentamethyldiethylenetriamine, dimethylpropyleneurea (DMPU), dimethylimidazolidinone (DMI), dimethylcarbonate (DMC), dimethylsulphoxide (DMSO), dimethylformamide (DMF). Other possible ligands are diethylether ($Et_2O$), 1,2-dimethoxyethane (monoglyme), bis (2-methoxyethyl)ether (diglyme), dioxane, tetrahydrofuran. Where R comprises L, L is a functional group capable of acting as a Lewis base donor, preferred ones being dimethylaminomethyl(—$CH_2N(CH_3)_2$), ethyleneoxy(—$OCH_2CH_2O$—), ethyleneamine(—$N(R)CH_2CH_2N(R)$—), carboxy(—$CO_2H$) and ester (—$CO_2CH_2$). It is to be understood that these listings are by no means exhaustive and other suitable organic donor ligands or functional groups (Lewis bases) may be used.

The alkali or alkaline earth metal complex will usually contain 1–4 ligand molecules to ensure oil solubility, i.e. the value of n will usually be 1, 2, 3, or 4. Where R comprises L, n can be and often is zero.

Whilst any of the alkali (Group I: Atomic Nos. 3, 11, 19, 37, 55) and alkaline earth (Group II: Atomic Nos. 4, 12, 20, 38, 56) may be used as the metal (or metals) M, preferred are the donor ligand complexes of sodium, potassium, strontium or calcium. The preferred source of the metal, on economic grounds, will typically be the hydroxide or oxide.

Whilst the organometallic compounds described may be added directly to the fuel, either external to the vehicle or by using an on board dosing system, they will preferably first be formulated as a fuel additive composition or concentrate containing the substance, or mixtures thereof possibly along with other additives, such as detergents, anti foams, dyes, cetane improvers, corrosion inhibitors, gum inhibitors, metal deactivators, de-emulsifiers, upper cylinder lubricants, anti-icing agents, etc., in an organic carrier miscible with the fuel.

The composition of the present invention reduces the ignition temperature and/or promotes oxidation of particulate matter. Without wishing to be bound by theory, it is believed that there are four basic mechanisms to explain soot formation and decay. These are: mass growth, coagulation, pyrolysis and oxidation. Earlier workers have suggested that metallic additives appear to work by enhancing oxidation rather than reducing soot formation. Alkali and alkaline earth metals, particularly metal oxides thereof, have been shown to be effective in rich pre-mixed flame studies. Suggested mechanisms for alkali metals include a charge transfer process which limits coagulation, especially in the combustion space of a diesel engine cylinder, thus promoting soot burn out and limiting the formation of larger more stable soot particles. In this context "larger" refers to particle sizes in the ranges of 300 to 700 nanometres principle dimension. Alkaline earth metal ions are also believed to promote additionally the formation of OH radicals, an important species in the oxidation in fuel rich flames. Thus it is believed these attributes contribute to the surprising synergistic combustion influence of the combination of the alkali metal complexes and the alkaline earth metal complexes of the composition of the present invention.

In addition, the seemingly random low temperature oxidation of soot and the auto regeneration in the range of 185° C. to 220° C. for the preferred composition of the present invention may be due to the formation of short lived species, during the combustion or pyrolysis event, such as a superoxide or peroxide radical.

A particular advantage of the complexes of this invention is their low nuclearity, many being monomeric in character, although some are dimeric and trimeric, tetrameric or higher. This low nuclearity means that, in contrast to overbased metal soaps (i.e. the traditional method of providing oil-soluble metal compounds) the complexes used in accordance with the present invention provide a uniform distribution of metal atoms throughout the fuel, each metal atom theoretically being available to enhance combustion of particulates both within the engine and exhaust system and in traps. In contrast, the overbased metal soaps essentially consist of individual micelles containing a number of metal (e.g. alkali or alkaline earth metal) cations and inorganic anions, typically carbonate, surrounded by a shell of dispersant type molecules on the surface of the particle. Whilst some overbased soaps are stably dispersed, the metal will not be uniformly dispersed throughout the fuel as individual atoms, but in clusters, or micelles. Further, only a limited number of metal atoms are available on the surface of the micelle for action, so the effectiveness of those soaps is low. Also, since the soaps are non-volatile there is a significant risk of increased deposit formation in the engine itself and in the fuel injectors, including the fuel injectors of oil fire boilers etc.

The effectiveness of the composition of the present invention is also attributable to its volatility as the combustion process is a vapour phase reaction, essentially requiring the particulate suppressant to be volatile in order to have an effect.

The present invention will now be described only by way of the following non-limiting examples.

EXAMPLE 1

Preparation of 1,3-dimethylimidazolidinone adduct of sodium 2,2,6,6-tetramethylheptane-3,5-dionate: [Na(TMHD).DMI]

A round bottom flask was charged under nitrogen with sodium hydride (NaH, 4.8 g, 200 mmol), dry toluene (100 $cm^3$) and dimethylimidazolidinone (23.8 $cm^3$, 22.8 g, 200 mmol). 2,2,6,6-tetramethylheptane-3,5-dione (HTMHD, 43 $cm^3$, 37.97 g, 206 mmol) was then added dropwise by syringe against nitrogen flush. After the addition of a few drops an effervescence was noted. The solution was stirred and gently warmed (oil bath, 60° C.) during one hour before filtration. A 90% plus yield of NaTMHD.DMI crystals grew on refrigeration.

Melting point 70–72° C., C/H/N found versus (calculated) wt %, C 60.09 (60.00), H 9.14 (9.06) and N 8.67 (8.85), $^1H$ nmr in $C_6D_6$ shifts rel. to TMS 5.873 ppm (s, H, COCHCO), 2.609 (s, 6H, $NCH_3$), 2.570 (s, 4H, $CH_2CH_2$) and 1.396 (s, 18H, $C(CH_3)_3$).

EXAMPLE 2

Preparation of sodium salt of poly(isobutenyl) succinic acid, approx. 1,000 molecular weight [Na ($PIBSA_{1000}$)]

A suspension of powdered solid sodium hydroxide (8.04 g, 200 mmol) in a solution of poly(isobutenyl) succinic anhydride (PIBSA, 198.8 g, 200 mmol) in dry toluene (995 $cm^3$) was allowed to stir at ambient temperature during several days. The solids dissolved to yield a clear solution of 1000 molecular weight poly(isobutenyl)-succinic acid, monosodium salt.

EXAMPLE 3

Preparation of dimethylcarbonate adduct of the sodium salt of 2,6-ditertiarybutyl-4-methyl phenol: [$(NaBHT)_2$. 3DMC]

A solution of 2,6-ditertiarybutyl-4-methyl phenol (butylated hydroxy toluene, BHT, 21.8 g, 100 mmol) in dry toluene 100 $cm^3$) is added to a suspension of sodium hydride (2.4 g, 100 mmol) in dry toluene (100 $cm^3$) and dimethyl carbonate (12.64 $cm^3$, 13.51 g, 1.5 equiv) under inert atmosphere. Precipitation of white material accompanied the evolution of hydrogen gas and heat. After completion of the addition the reaction mixture was stirred at ambient temperature during some 60 minutes. The solids were isolated by filtration and dried under vacuum.

C/H/N found versus (calculated) wt %, C 62.40 (62.07) and H 8.28 (8.49).

EXAMPLE 4

Preparation of the dimethylimidazolidinone adduct of the strontium salt of 2,2,6,6-tetramethylheptane-3,5-dione; [$Sr(TMHD)_2$.3DMI]

HTMHD (21 $cm^3$, 18.54 g, 100.6 mmol) was added under inert atmosphere to a solution of dimethylimidazolidinone (30 $cm^3$, 32.32 g, 283 mmol) in dry toluene (20 $cm^3$) containing a piece (6 g) of strontium metal. An immediate effervescence was noted. The contents of the flask were stirred and warmed (80° C., oil bath) overnight yielding a yellowy solution and some colourless solids. The solids were dissolved by the addition of further toluene (30 $cm^3$) and unreacted Sr removed by filtration. Refrigeration yielded large block-shaped crystals of [$Sr(TMHD)_2$.3DMI] in 90% yield.

EXAMPLE 5

Preparation of the strontium salt of molecular weight 1,000 poly(isobutenyl) succinic anhydride [$Sr(PIBSA_{1000})_2$]

Poly (isobutenyl) succinic anhydride, 1,000 molecular weight, (69.48 g, 69 mmol) was weighed into a round-bottom flask. Dry toluene (347 $cm^3$) was added. The mixture was heated and stirred to form a homogenous solution. Strontium hydroxide octahydrate (6.90 g 26 mmol) was then added cautiously. Some frothing accompanied the addition. The mixture was refluxed during one hour then left to stir overnight. A Dean-Stark apparatus was then used to remove 3.8 $cm^3$ of water. The resulting slightly turbid solution was filtered, 0.7 g of solids were recovered. A final solution concentration of 0.56 wt % Sr as $Sr(PIBSA_{1000})_2$ was achieved.

EXAMPLE 6

Preparation of the sodium salt of molecular weight 420 poly(isobutenyl)succinic anhydride.

A thermostatted 'Soverel'™ reactor was charged with BP Hyvis XD-35™ poly(isobutene) (665.79 g, no. av. mol. wt. 320, 2.08 mol) and maleic anhydride (411.79 g, 4.2 mol, 2.02 equivalents). The contents were heated to 200° C. with oil circulated through the jacket by an external oil bath and strongly stirred during 8 hours. A viscous, dark brown solution formed. The unreacted maleic anhydride was removed under vacuum, along with some of the unreacted poly(isobutene). A material analysing at 11.2 wt % poly (isobutene) was recovered.

A sample of the material prepared above (535.78 g, theoretical 1.125 moles $PIBSA_{420}$) was charged to a flat-bottomed glass vessel fitted with turbine agitator, thermocouple well and charging port. The vessel was further charged with Solvesso 150™ (502.26 g). The contents were warmed to 82° C. via an external oil bath and stirred until homogenous. Beaded sodium hydroxide (46.03 g, 1.15 moles) was then charged. The resulting suspension of white 1 mm beads in brown solution was stirred overnight at 78° C. Material (1066.19 g) containing 2.13 wt % sodium as 420 molecular weight poly(isobutenyl)succinic acid, monosodium salt, was obtained.

EXAMPLE 7

Preparation of No. Average Molecular Weight 420 Poly(isobutylene) Succinic Anhydride—$PIBSA_{420}$.

A reactor was charged with BP-Hyvis XD-35™ poly (isobutylene) (12.906 kg, 40.33 mol) and heated to is 100° C. with stirring before adding maleic anhydride (5.966 kg, 60.38 mol). The temperature of the oil bath supplying the reactor jacket was set to 220° C., the internal reactor temperature reached 185° C. after three hours. This was taken as the start of the reaction time. The oil bath temperature was lowered to 212° C. and the reaction mix stirred during some 30 hours. At the end of this period a vacuum was applied and the excess amleic anhydride distilled out. After 15 hours under vacuum, residual maleic anhydride content was 0.0194 wt % and residual PIB 19.9 wt %. Some 13.888 kg of brown, viscous material was recovered.

EXAMPLE 8

Preparation of Strontium Salt of $PIBSA_{420}$

A reactor was charged with material prepared in Example 7 (555.81 g, 445.99 g, 1.06 mol $PIBSA_{420}$, 109.82 g, 343 mmol $PIB_{320}$) and Solvesso150™ (346.46 g). This mixture was stirred and heated until homogenous. Strontium hydroxide octahydrate (140.43 g, 0.53 mol) was then added and heated to 50° C. overnight. Water (40.62 g), was removed by heating the solution to 120° C. Product contained 5.36 wt % Sr as $Sr(PIBSA_{420})_2$.

EXAMPLE 9

Preparation of Potassium Salt of $PIBSA_{420}$

An oil-jacketed reactor was charged with material prepared in Example 13 (440.78 g, 0.85 mol PIBSA420), and Solvesso150™ (462.53 g). The contents were warmed to 50° C. and stirred until homogenous. KOH flake (47.88 g, 0.77 mol if 10% $H_2O$) was then added with stirring and the resulting suspension left to stir overnight. The solids dissolved and FTIR analysis showed an absence of the 1863 $cm^{-1}$ absorption due to the PIBSA. The solution contained 3.33 wt % K as $K(PIBSA_{420})$.

EXAMPLE 10

Preparation of No. Average Molecular Weight 360 poly(isobutylene) succinic anhydride ($PIBSA_{360}$).

A number average molecular weight 260 poly (isobutylene) ($PIB_{260}$, BP-Napvis X10™, 586.2 g, 2.257 moles) was charged to a one litre oil-jacketed reaction vessel. The vessel was further charged with maleic anhydride (442.71 g, 4.52 moles). The mixture was heated to 200° C. and stirred during 24 hours. At the end of this period, the maleic anhydride was removed by vacuum distillation.

A dark brown, viscous oil was recovered, this analysed as $PIBSA_{360}$ containing 8.1% m/m $PIB_{260}$.

EXAMPLE 11

Preparation of sodium salt of No. Average Molecular Weight 360 Poly(isobutylene) Succinic Acid-Na ($PIBSA_{360}$)

A reactor was charged with a sample of poly(isobutylene) succinic anhydride prepared as above (412.91 g, 392.26 g PIBSA360, 1.096 moles, 20.65 g PIB260). The vessel was further charged with Solvesso 150™ (526.19 g) and the liquids heated and stirred to form a homogenous deep brown solution. Sodium hydroxide as dry pellets (43.84 g, 1.096 mol) was then added. The resulting suspension was stirred overnight at 70° C. FTIR indicated complete consumtion of the PIBSA and formation of carboxylic acid and carboxylic acid salt. The solution was decanted and analysed as containing 2.35 wt % Na as $Na(PIBSA_{360})$.

EXAMPLE 12

Preparation of strontium salt of No. Average Molecular Weight 360 Poly(isobutylene) Succinic Acid-$Sr(PIBSA_{360})_2$ A jacketed reactor was charged with poly(isobutylene) succininc anhyciride prepared as in Example 16 (468.43 g, 451.10 g, 1.26 moles PIBSA, 37.33 g PIB) and Solvesso 150™ (568.90 g), the two were heated to 50° C. and stirred to yield a homogeneous solution. $Sr(OH)_2.8H_2O$ (170.79 g, 0.64 mol) was then added. The resulting suspension was then stirred until the solids had dissolved. No attempt was made to separate the water.

Comparative Example 1

Preparation of a 25 wt % solution of sodium salt of tertiary amyl alcohol, [NaOtAm], as a 20 wt % solution in xylene.

Sodium stored under mineral oil was cleaned of the outer layer of oxide/hydroxide then cut into 1 cm cubes under toluene. The pieces were shaken dry in air, then charged (50.27 g) to a tared electrically heated vessel equipped with nitrogen flush and carrot valve. The sodium was melted out then added via the valve and under inert atmosphere to a round bottom flask containing dry mixed xylenes (400 g, 465 $cm^3$) 38.45 g (1.67 moles) was found to have been so transferred. Further dry mixed xylenes (175 $cm^3$, 152 g) were then added to the reaction flask. The heated vessel was then replaced with a reflux condenser. The reaction flask was additionally fitted with a pressure equalising dropping funnel. The flask was heated in an oil bath until the sodium became molten. Rapid stirring yielded a silvery suspension. The dropping funnel was charged with tertiary amyl alcohol (182 $cm^3$, 155 g). The alcohol was added with caution over about thirty minutes. A moderate evolution of hydrogen was noted. The reaction was heated with stirring during some 18 hours during which time a clear, colourless solution resulted. The solution was transferred through a cannula to dry bottles which were then firmly sealed against ingress of oxygen or moisture.

Comparative Example 2

Preparation of sodium dodecylbenzene sulphonate overbased eight times with sodium carbonate.

A stable dispersion in mineral oil of overbased sulphonic acid was prepared as described in GB-A-1,481,553, save that poly(isobutenyl)succinic anhydride of average molecular weight 1,000 (142 g) versus 560 (71 g) was used.

Comparative Example 3

Sodium tert-butoxide in Propan-2-ol

All aparatus was dried in an oven at 120° C. and cooled either under a flow of nitrogen or during admission to the dry box. A round-bottom flask was charged in the dry box with sodium tert-butoxide powder (20.126 g, Aldrich, fresh bottle). The flask was stoppered and removed from the dry box and fitted with nitrogen flush, overhead stirrer and pressure-equalised dropping funnel. The dropping funnel was then charged with anhydrous propan-2-ol (820.94 g, Aldrich) by cannula from the 'Sure-Seal'™ bottle. The alcohol was added slowly with stirring and gentle warming to give a pale green solution of sodium tert-butoxide in propan-2-ol.

Test Protocol

The tests were carried out in a Renault truck on a rolling road dynamometer, detailed specifications are given below.

Figure 2:
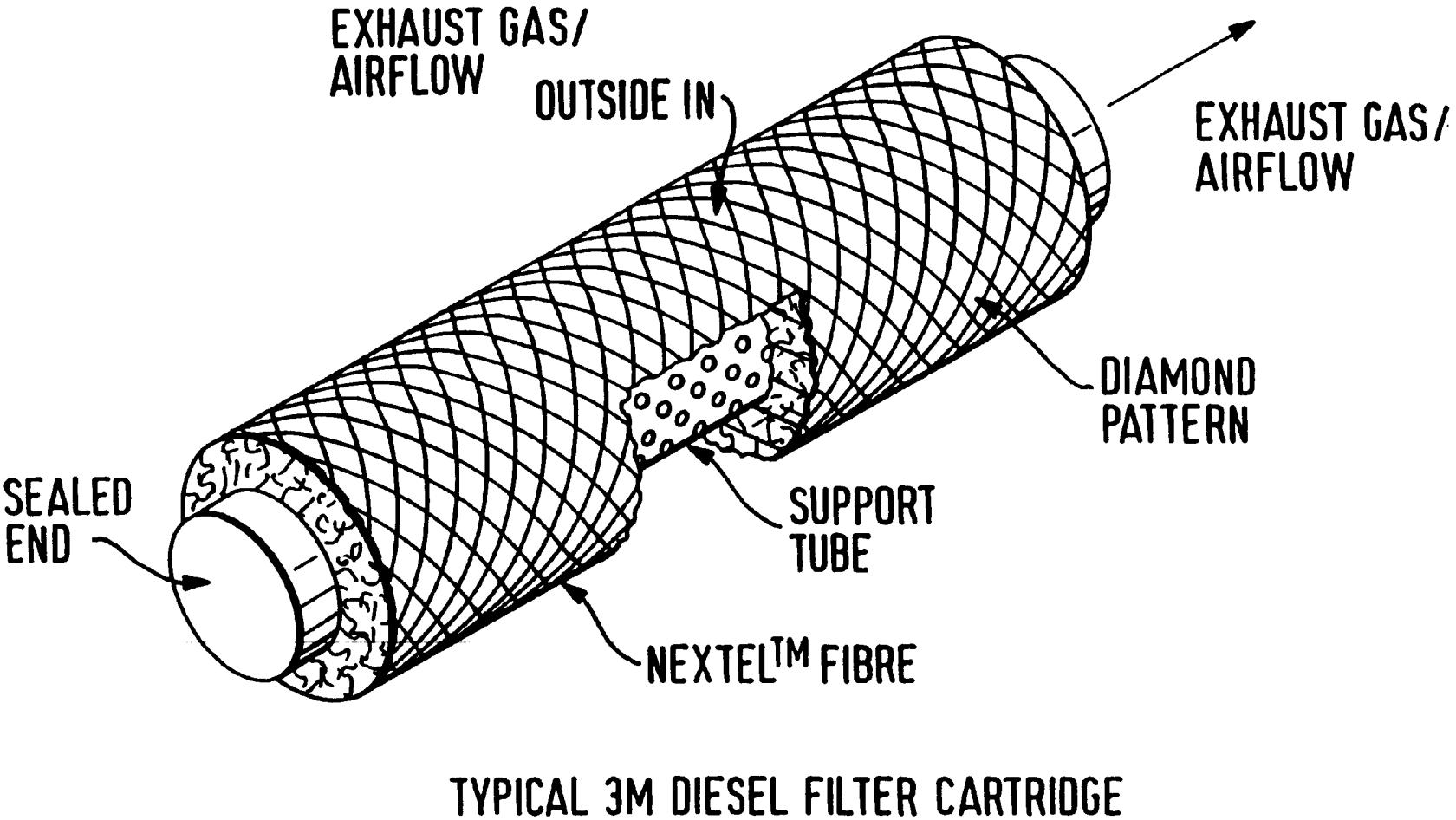
Figure 3:
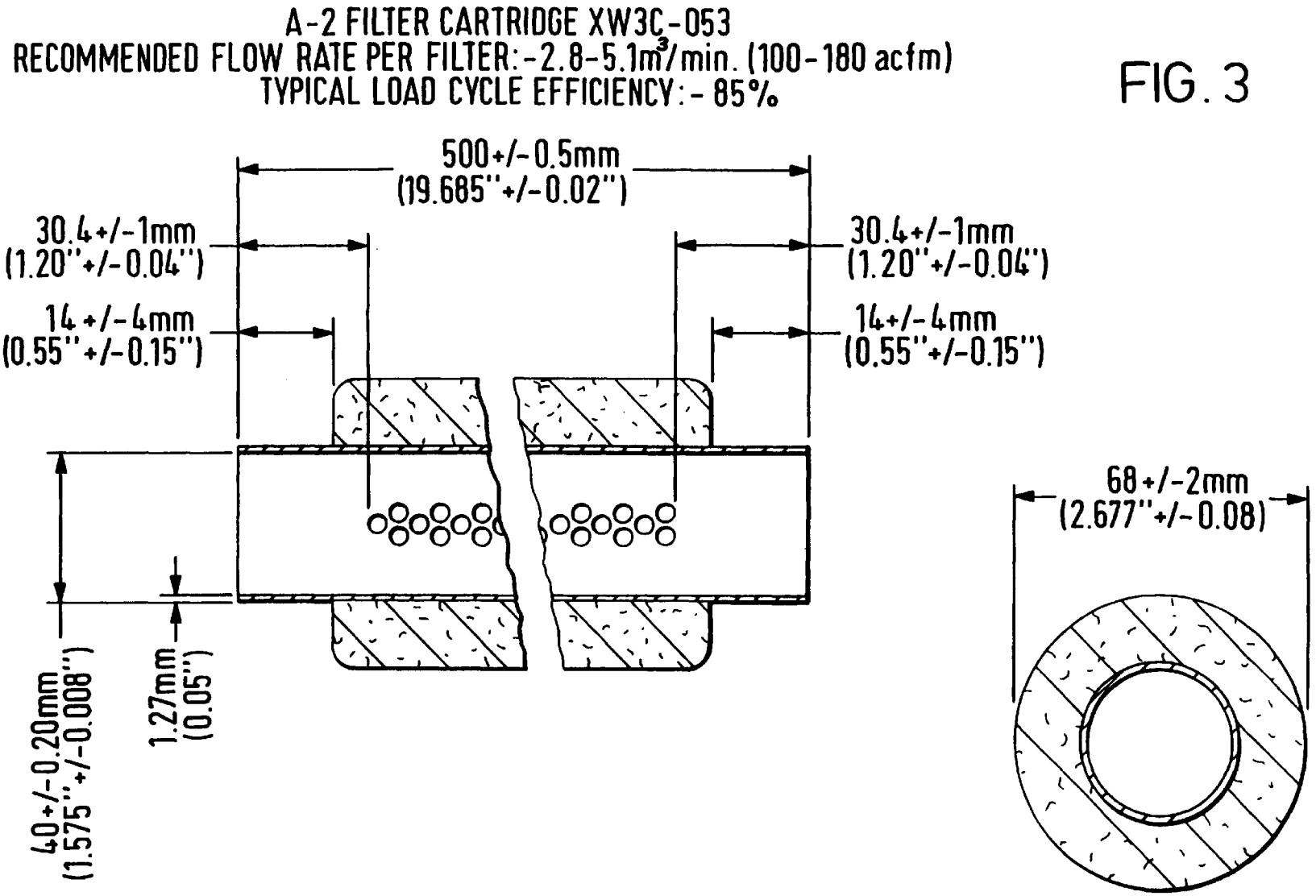

MAKE: Renault 50 Series S35 truck
FIRST REGISTERED: Aug. 14th 1990
UNLADEN WEIGHT: 2483 kg
MAX. LADEN WEIGHT: 3500 kg
ENGINE: PERKINS PHASER 90, normally aspirated, 4 Cylinder in line water cooled, 16.5:1 Compression ratio
ENGINE CAPACITY: 3990 $cm^3$
RATED POWER: 62 kW at 2800 rpm
BORE: 100 mm
STROKE: 127 mm
FUEL PUMP: Bosch type EPVE direct injection design
TRANSMISSION: Rear wheel drive The vehicle was additionally equipped with an exhaust gas filter or trap. The filter trap comprised radial flow filter cartridges XW3C-053 (from 3M Corporation) employed in parallel—as shown in FIG. 1. The cartridges were arranged at the corners of an equilateral triangle—as shown in FIG. 1. Nextel (Trade mark of 3M Corporation) fibre is supplied wound in spiral fashion about a collandered 50×4 cm steel tube—as shown in FIGS. 2 and 3. The cartridges were used as supplied. The distance from the engine manifold to the entrance to the trap was one meter. The exhaust pipe and trap were lagged with insulating material.

Additised fuel was prepared by dissolving the required amounts of additive in one litre of base diesel fuel, then diluting in the base fuel such that the fuel finally contained an additional 5 ppm m/m of the metal above background level. Base fuel used was BPD26, as specified below:

DIESEL ANALYSIS

| | |
|---|---|
| DESCRIPTION OF SAMPLE | BPD26 |
| SAMPLE NO. | 944929 |
| DENSITY @ 15° C. | 0.8415 |
| VISCOSITY @ 20° C. | |
| VISCOSITY @ 40° C. | 3.060 |
| CLOUD POINT ° C. | −5 |
| CFPP ° C. | −14 |
| POUR POINT ° C. | −15 |
| FLASH POINT ° C. | 70.5 |
| SULPHUR % WT. | 0.13 |
| Initial boiling point @ ° C. | 185.5 |
| 5% VOL. @ ° C. | 209.8 |
| 10% VOL. @ ° C. | 224 |
| 20% VOL. @ ° C. | 246.1 |
| 30% VOL. @ ° C. | 260.8 |
| 40% VOL. @ ° C. | 271.5 |
| 50% VOL. @ ° C. | 280.6 |
| 65% VOL. @ ° C. | 294.8 |
| 70% VOL. @ ° C. | 299.6 |
| 85% VOL. @ ° C. | 319.6 |
| 90% VOL. @ ° C. | 330.1 |
| 95% VOL. @ ° C. | 347.0 |
| FBP @ ° C. | 360.4 |
| % VOL. RECOVERY | 98.1 |
| % VOL. RESIDUE | 1.8 |
| % VOL. LOSS | 0.1 |
| C.C.I. (IP41) | 54.5 |
| C.C.I. (IP380) | 53.2 |
| CETANE IMPROVER - % | NIL |
| CETANE NUMBER | 54.2 |

The test was in two parts;

A soot collection or trap blocking phase, and

A forced filter regeneration or burn off stage.

The soot collection phase consisted of running the truck at steady speed and level road drag power for the unladen vehicle such that for a clean trap the exhaust gas temperature was about 195° C. at the inlet to the trap. This driving condition was continued until the soot loading caused the pressure drop across the filter to reach a value of 200 mbar (150 mbar was used during some early runs).

The forced filter regeneration stage entailed increasing the exhaust gas temperature until the soot collected on the trap ignited and burnt off. This was achieved by increasing vehicle speed to about 90 km/hr and dynamometer load towards 300 Nm at 5 Nm/min. This was done at the conclusion of each sooting phase i.e. when the pressure drop reached 200 mbar.

Ignition of the soot was inferred by observing a decrease of pressure drop across the filter. 'Forced' ignition occurred at exhaust gas temperatures of >300° C. 'Spontaneous' ignition is that which occurs at or below about 200° C.

Each sequence of runs using a given additised fuel was preceded by a minimum of three sequences of trap blocking and soot burn off or forced regeneration, as described above. For this base untreated fuel was used. Typically, the exhaust gas temperature range 500 to 550° C. were reached. The time to load the trap decreased with successive runs using base fuel (reference fuel data).

Runs using additised fuel were characterised in that spontaneous soot ignition and prolonged soot collection phases to reach the 'blocked' condition were observed. The degree to which these phenomena were observed varied between one additised fuel and another. Additives were characterised as follows.

An additive was considered highly effective if two or fewer sequences of filter sooting and forced regeneration were required before a period of prolonged soot collection running, i.e. greater than 12 hours, was achieved without: the need for a forced regeneration; typically ten or more spontaneous soot ignitions were observed when this was achieved.

An additive was considered to be of low effectiveness if the above conditions regarding prolonged soot collection running and/or number of forced regenerations required were not met, but nevertheless some spontaneous ignitions were observed.

An additive was considered ineffective if after five sequences of soot collection running and forced burnoff no episodes of spontaneous ignition or prolonged running, i.e. greater than six hours, had been observed.

Compounds tested in chronological order were:

[Na(PIBSA$_{1000}$)] (Example 2),

[Na tert amylate] (Comparative Example 1),

[Sr(PIBSA$_{1000}$)$_2$] (Example 5),

[Na (PIBSA$_{1000}$)]/[Sr(PIBSA$_{1000}$)$_2$] mixture (Na:Sr=3:1) (Example 2/5), Over based sodium dodecylbenzene sulphonate (Comparative Example 2), and Sodium tert-butoxide in isopropanol (comparative Example 3).

During the testing period the total distance accumulated was in excess of 30,000 km. As testing progressed the sooting time with base fuel increased, i.e. it became more difficult to eliminate the memory of additised fuels. A typical soot collection running sequence on base fuel was 5.14, 2.78, 2.18, 1.42 and 0.80 hours.

Results

For sodium tertiary amylate (Comparative Example 1) the soot collection running times to achieve 200 mBar were: 0.72, 2.10, 1.80, 9.68 and 4.52 hours. According to the protocol, the additive is regarded as of low effectiveness.

The overbased sodium dodecylbenzene sulphonate (Comparative Example 2) required two sequences of sooting and burn off, after which it ran for some 12 hours. Performance was marginal; on two occasions the exhaust pressure reached 200 mBar. The additive is of low effectiveness.

For sodium butyrate in iso-propanol (Comparative Example 3) the soot collection running times to achieve 200 mBar were: 2.85, 2.61, 2.46, 6.34, 2.53, and 2.22 hours. According to the protocol, this additive is also classified as ineffective.

All other compounds tested were highly effective in preventing filter blocking, according to the test protocol.

Additives are here ranked according to the mean pressure drop across the trap. Low pressure drop reflects ability to maintain trap cleanliness.

| Rank Order | Example | Compound | Fuel Bat. No. | Run Time (hour) | No. of forced regens. | Mean trap back pressure (mBar) |
|---|---|---|---|---|---|---|
| 1 | 2/5(3:1) | Na/SrPIBSA | 951514 | 16.99 | 1 | 75 |
| 2 | 2 | NaPIBSA | 951075 | 24.63 | 0 | 93 |
| 3 | 5 | Sr(PIBSA)$_2$ | | 12.56 | 1 | 117 |
| 4 | Comp 3 | Na overbased sulphonate | 951811 | 12.00 | 2 | 104 |

These results show the surprising synergistic benefit of the composition of the present invention in improving the oxidation of carbonaceous products derived from the combustion or pyrolysis of fuel.

Trap Regeneration Tests Using Cracked Wall Trap

A Peugeot 309 diesel, specified as below, was run in the manner described in the Test Protocol, save that no base fuel was used and the 'Nextel™' fibre trap was replaced by a 'cracked wall' trap prepared from Corning EX80™. Higher dose rates of metal were found to be required in order to obtain 'spontaneous' regeneration of the trap (i.e. regeneration without the need to increase engine speed and load). Metals were blended into the fuel as the complexes prepared by the method of Examples 11 and 12. Results are presented in the form of peak back pressure and corresponding exhaust gas temperature at the trap inlet at onset of spontaneous trap regeneration.

| | |
|---|---|
| Model | 309 D |
| Body | 4 seat saloon |
| Arrangement | Front wheel drive |
| Kerb Weight kg | 990 |
| Engine type | Diesel indirect injection |
| Swept volume 1 | 1.905, normally aspirated |

-continued

| | |
|---|---|
| Compression ratio | 23.5:1 |
| Bore, stroke mm | 83, 88 |
| Fuel pump | Rotary type Rotodiesel |
| Transmission | 5 speed manual |

| Test | Na ppm | Sr ppm | Temp ° C. | Pressure mBar |
|---|---|---|---|---|
| 954388 | 8 | 2 | >300 | >300 |
| 954527 | 10 | 2.5 | <260 | <250 |
| 954724 | 14 | 3.5 | <200 | <250 |
| 954673 | 20 | 5 | <200 | <150 |
| 960663 | 25 | 0 | <200 | <200 |

Acceptable temperature and pressure for spontaneous regeneration Lies within the design and operation philosophy of the trap/engine combination, in particular the fuel consumption penalty, due to the back pressure, that is deemed acceptable.

Comparison of the results for Test 954673 versus 960663 shows a surprising benefit for the use of a combination of metals over a single metal in that peak pressure prior to spontaneous regeneration is significantly lowered by the combination at same total metal dose rate.

Engine out Emissions Reduction

A Peugeot 306 diesel car, specified as below, was used to collect emissions data using the test procedure 91/441/EEC. Base fuel was CEC RF03 A84. Fuel additive concentrates were prepared by the methods given in examples 9–12 using molecular weight 360 PIBSA throughout. The concentrates were blended into fuels by standard methods.

| | |
|---|---|
| Model | 306 XNd |
| Body | 4 Seat saloon |
| Arrangement | Front wheel drive |
| Kerb weight kg | 1160 |
| Engine type | Diesel indirect injection |
| Swept volume 1 | 1.905 Normally aspirated |
| Compression ratio | 23:1 |
| Bore,. stroke mm | 83, 88 |
| Fuel pump | Rotary type Rotodiesel |
| Transmission | 5 speed manual |

The following particulates emissions data was obtained, based on the 'Overall Result' from procedure 91/441/EEC.

| Test No. | Fuel No. | Additive metal | Metal content (ppm) | Particulates (g/km) | % Change in particulates vs 257E95 |
|---|---|---|---|---|---|
| 257E95 | 951899 | Base fuel | N/A | 0.107 | N/A |
| 297E95 | 954534 | K | 10 | 0.088 | −18.1 |
| 303E95 | 954535 | Sr | 10 | 0.092 | −14.1 |
| 308E95 | 954536 | Na | 10 | 0.087 | −19.0 |
| 313E95 | 954537 | Na/Sr | 8 + 2 | 0.078 | −26.8 |
| 318E95 | 954758 | K | 10 | 0.087 | −18.8 |
| 324E95 | 954757 | Na | 10 | 0.085 | −20.2 |
| 036E96 | 960662 | Sr | 10 | 0.089 | −16.9 |

Good reproducibility is shown between the pairs of tests using a given metal, particularly for sodium and potassium. The result with a combined 10 ppm of sodium and strontium is unexpectedly much better than any for either metal alone at this dose rate. This shows the synergistic benefit resulting from the use of the combination of metals to improve the combustion of fuel.

The results show the surprising synergistic effect of the composition of the present invention in improving the combustion of fuel and/or improving the oxidation of carbonaceous products derived from the combustion or pyrolysis of fuel.

Other modifications will be apparent to those skilled in the art without departing from the scope of the present invention.

We claim:

1. A method of regenerating a particulate filter trap, said method comprising adding to a fuel before the combustion thereof a composition comprising a mixture of organo-metallic complexes, wherein the organo-metallic complexes only consist of Group I and Group II organo-metallic complexes and wherein the composition comprises at least one Group I organo-metallic complex and at least one Group II organo-metallic complex.

2. A method according to claim 1 wherein the total concentration of the metals of the Group I and the Group II organo-metallic complexes in the fuel before combustion is 100 ppm or less.

3. A method according to claim 1 wherein the total concentration of the metals of the Group I and the Group II organo-metallic complexes in the fuel before combustion is 30 ppm or less.

4. A method according to claim 1 wherein the filter trays is a 'cracked wall' trap and the total concentration of the metals of the Group I and the Group II organo-metallic complexes in the fuel before combustion is 100 ppm or less.

5. A method according to claim 1 wherein the filter trays is a 'deep bed' trap and the total concentration of the metals of the Group I and the Group II organo-metallic complexes in the fuel before combustion is 50 ppm or less.

6. A method according to claim 1 wherein the Group I organo-metallic complex comprises a complex of Na and/or K.

7. A method according to claim 1 wherein the Group II organo-metallic complex comprises a complex of Sr and/or Ca.

8. A method according to any one of claims 1 wherein the Group II organo-metallic complex comprises a complex of Sr.

9. A method according to claim 1 wherein each organo-metallic complex is fuel soluble.

10. A method according to claim 1 wherein each organo-metallic complex is soluble in a fuel-compatible solvent to the extent of 10 wt % or more.

11. A method according to claim 10 wherein each organometallic complex is soluble in a fuel-compatible solvent to the extent of 25 wt % or more.

12. A method according to claim 10 wherein each organometallic complex is soluble in a fuel-compatible solvent to the extent of 50 wt % or more.

13. A method according to claim 1 wherein the ratio of Group I organo-metallic complex to Group II organo-metallic complex is in the range of from 20:1 to 1:20.

14. A method according to claim 13 wherein the ratio of Group I organo-metallic complex to Group II organo-metallic complex is in the range of from 10:1 to 1:10.

15. A method according to claim 1 wherein in the composition there is more Group I organo-metallic complex than Group II organo-metallic complex.

16. A method according to claim 13 wherein the ratio of Group I organo-metallic complex to Group II organo-metallic complex is in the range of from 20:1 to 1:1.

17. A method according to claim 13 wherein the ratio of Group I organo-metallic complex to Group II organo-metallic complex is in the range of from 10:1 to 1:1.

18. A method according to claim 1 wherein each of the organo-metallic complexes is of the formula $M(R)_m.nL$ where each M independently represents a cation of an alkali metal or an alkaline earth metal, of valency m; R is the residue of an organic compound RH, where R is an organic group containing an active hydrogen atom H replaceable by the metal M and attached to an O, S, P, N or C atom in the group R; n is a positive integer indicating the number of donor ligand molecules forming a bond with the metal cation, but which can be zero; and L is a species capable of acting as a Lewis base.

19. A method according to claim 18 wherein R and L for at least one of the complexes are present in the same molecule.

20. A method according to claim 18 wherein R and L for both the complexes are in the same molecule.

21. A method according to claim 18 wherein $M(R)_m.nL$ for at least one of the complexes is derived from the reaction of an alkyl or alkenyl succinic anhydride or its hydrolysis product with a Group I or Group II metal hydroxide or oxide.

22. A process according to claim 1 wherein each of the organometallic complexes is dosed to the fuel at any stage in the fuel supply chain.

23. A process for improving the combustion of fuel and/or improving the oxidation of carbonaceous products derived from the combustion or pyrolysis of fuel, the process comprising adding to the fuel before the combustion thereof a composition comprising a mixture of organo-metallic complexes, characterised in that the organo-metallic complexes only consist of Group I and Group II organo-metallic complexes and wherein the composition comprises at least one Group I organo-metallic complex and at least one Group II organo-metallic complex, in which each of the organo-metallic complexes is of the formula $M(R)_m.nL$ where each M independently represents a cation of an alkali metal or an alkaline earth metal, of valency m; R is the residue of an organic compound RH, where R is an organic group containing an active hydrogen atom H forming part of a carboxyl group and replaceable by the metal M; n is a positive integer indicating the number of donor ligand molecules forming a bond with the metal cation, but which can be zero; and L is a species capable of acting as a Lewis base.

24. A process according to claim 23 wherein R and L for at least one of the complexes are present in the same molecule.

25. A process according to claim 23 wherein R and L for both the complexes are in the same molecule.

26. A process according to claim 23 wherein $M(R)_m.nL$ for at least one of the complexes is derived from the reaction of an alkyl or alkenyl succinic anhydride or its hydrolysis product with a Group I or Group II metal hydroxide or oxide.

27. An additive composition for liquid hydrocarbon fuels comprising a mixture of organo-metallic complexes, the organo-metallic complexes only consist of Group I and Group II organo-metallic complexes and wherein the composition comprises at least one Group I organo-metallic complex and at least one Group II organo-metallic complex, in which each of the organo-metallic complexes is of the formula $M(R)_m.nL$ where each M independently represents a cation of an alkali metal or an alkaline earth metal, of valency m; R is the residue of an organic compound RH, where R is an organic group containing an active hydrogen atom H forming part of a carboxyl group and replaceable by the metal M; n is a positive integer indicating the number of donor ligand molecules forming a bond with the metal cation, but which can be zero; and L is a species capable of acting as a Lewis base.

28. An additive composition according to claim 27 wherein R and L for at least one of the complexes are present in the same molecule.

29. An additive composition according to claim 27 wherein R and L for both the complexes are in the same molecule.

30. An additive composition according to any one of claim 27 wherein $M(R)_m.nL$ for at least one of the complexes is derived from the reaction of an alkyl or alkenyl succinic anhydride or its hydrolysis product with a Group I or Group II metal hydroxide or oxide.

* * * * *